US008485209B2

(12) United States Patent
Imhof

(10) Patent No.: US 8,485,209 B2
(45) Date of Patent: Jul. 16, 2013

(54) MOSQUITO SPRING NET

(75) Inventor: Christopher J. Imhof, Denver, CO (US)

(73) Assignee: Montessori School of Denver, Denver, CO (US)

( * ) Notice: Subject to any disclaimer, the term of this patent is extended or adjusted under 35 U.S.C. 154(b) by 98 days.

(21) Appl. No.: 12/693,209

(22) Filed: Jan. 25, 2010

(65) Prior Publication Data

US 2010/0186792 A1 Jul. 29, 2010

Related U.S. Application Data

(60) Provisional application No. 61/147,028, filed on Jan. 23, 2009.

(51) Int. Cl.
*E04H 15/48* (2006.01)
*B65D 30/20* (2006.01)
*B65B 33/02* (2006.01)

(52) U.S. Cl.
USPC ..... 135/143; 135/126; 135/128; 220/9.3

(58) Field of Classification Search
USPC ..... 135/121, 126, 128, 143, 901, 902; 220/9.1–9.3; 383/104
See application file for complete search history.

(56) References Cited

U.S. PATENT DOCUMENTS 1,990,804 A * 2/1935 Watson ..... 135/128
2,575,893 A * 11/1951 Seaman ..... 383/25
4,224,754 A * 9/1980 Derryberry ..... 43/1
5,564,454 A * 10/1996 Curley et al. ..... 135/126
5,618,246 A * 4/1997 Zheng ..... 482/35
5,765,748 A * 6/1998 Chen ..... 229/125.22
6,494,224 B2 * 12/2002 Zheng ..... 135/125
6,612,453 B2 * 9/2003 Joo-Tai ..... 220/9.2
6,830,170 B2 * 12/2004 Abel ..... 224/634
2002/0186901 A1 * 12/2002 Lin ..... 383/104
2003/0106895 A1 * 6/2003 Kalal ..... 220/9.2
2003/0183630 A1 * 10/2003 Schneider et al. ..... 220/9.2
2005/0034748 A1 * 2/2005 Gadd et al. ..... 135/126
2006/0076044 A1 * 4/2006 Zheng ..... 135/126
2007/0095271 A1 * 5/2007 Yang ..... 114/361

OTHER PUBLICATIONS

Kaplan, Eva, "A better mosquito net," Scientific American, Dec. 16, 2007.

* cited by examiner

*Primary Examiner* — David Dunn
*Assistant Examiner* — Danielle Jackson
(74) *Attorney, Agent, or Firm* — Perkins Coie LLP

(57) ABSTRACT

A collapsible mosquito spring net assembly includes a support structure having a front support ring, a back support ring, and a spring coil support. A mosquito net covers the support structure. The collapsible mosquito spring net assembly further includes closure elements and a net cover assembly including a net, an elastic element, and an elastic pull for opening and closing the spring net assembly. The collapsible mosquito spring net optionally comprises an outer lower cover. A method for protecting users from exposure to insects includes: providing a collapsible mosquito spring net assembly; setting up the mosquito spring net assembly on the floor, ground, or other surface by releasing the closure elements; and securing the net cover assembly from inside the mosquito spring net assembly by pulling taut the elastic pull.

20 Claims, 8 Drawing Sheets

MOSQUITO SPRING NET

CROSS REFERENCE TO RELATED APPLICATIONS

This application claims the benefit of U.S. Provisional Application No. 61/147,028, filed Jan. 23, 2009, which is incorporated herein by reference.

BACKGROUND

Malaria is a global problem, particularly in sub-Saharan Africa. Each year, as many as 500 million people are afflicted. Most of the afflicted are pregnant women and young children because of their low or non-existent immunity to the disease. At least 800,000 children under the age of five in sub-Saharan Africa die every year from the disease.

Many organizations, such as the World Health Organization (WHO), the United Nations' Children's Fund (UNICEF), the World Bank, and the U.S. Agency for International Development (USAID) have malaria control programs that focus at least in part on distributing mosquito nets that protect people from infectious mosquito bites while sleeping. While the typical nets that are currently distributed may be effective in households with beds for every family member, there are many drawbacks in other settings.

In many African communities, most children under five years old sleep on the floor of their homes. The mosquito nets that are currently distributed, which typically hang from the roof, are much less effective at preventing mosquito bites on children who sleep on the floor. Additionally, many homes in African communities are small mud huts with thatched roofs. This makes it very difficult to set up the hanging nets. Once hung, the nets are large and cumbersome, taking up a large amount of space in the small homes. Therefore, the nets are not only difficult to set up, but must be taken down during the day to create living space. In summary, the current net designs are relatively ineffective, cumbersome, and difficult to use on a daily basis for children who sleep on the floor in regions such as sub-Saharan Africa.

SUMMARY

A collapsible mosquito spring net assembly includes a support structure having a front support ring, a back support ring, and a spring coil support. A mosquito net covers the support structure. The collapsible mosquito spring net assembly further includes closure elements and a net cover assembly including a net, an elastic element, and an elastic pull for opening and closing the spring net assembly. The collapsible mosquito spring net optionally comprises an outer lower cover.

A method for protecting users from exposure to insects includes: providing a collapsible mosquito spring net assembly; setting up the mosquito spring net assembly on the floor, ground, or other surface by releasing the closure elements; and securing the net cover assembly from inside the mosquito spring net assembly by pulling taut the elastic pull.

Other features and advantages will become apparent from the following detailed description. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION

Various embodiments will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
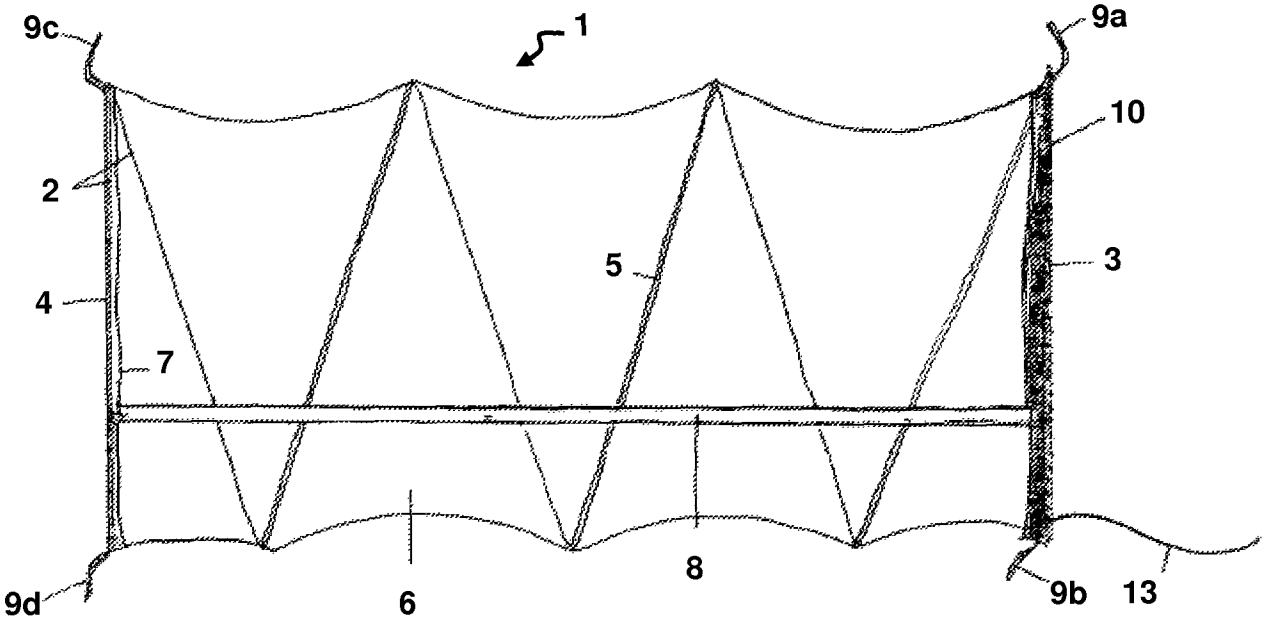
FIG. 1 is a perspective view of an expanded mosquito spring net assembly, according to one embodiment.

The mosquito spring net assemblies described herein may be used to protect users from insect bites in many situations, such as to protect a child sleeping on the floor in a region where malaria-infected mosquitoes are prevalent. Turning now in detail to the drawings, as shown in FIG. 1, an expanded mosquito spring net assembly 1, includes a support structure 2, a mosquito net 6, closure elements 9*a*, 9*b*, 9*c*, 9*d*, and a net cover assembly 10. The support structure 2 preferably includes a front support ring 3, a back support ring 4, and a spring coil support 5 to create a hollow interior structure in which a child or other person may sleep. In one embodiment, the support structure 2 has a length of approximately three feet, and a diameter of approximately one to two feet, such that it is suitable for a child.

The support structure 2 may be constructed from a single piece of flexible material or may include two or more separate attached pieces. In one embodiment, the support structure 2 comprises a suitable flexible material such as plastic, a fibrous composite material, or a metal so that the spring coil support 5 may be compressed to bring the front and back support rings 3, 4 near each other. In one embodiment, the support structure includes 9 gauge aluminum wire.

In one embodiment, four closure elements 9*a*, 9*b*, 9*c*, 9*d* are attached to the front and back support rings 3, 4. The closure elements 9*a*, 9*b*, 9*c*, 9*d* may comprise fabric ties, hooks, snaps, or any other means to secure the front and back support rings 3, 4 together when the spring coil support 5 is compressed.

In one embodiment, the mosquito net 6 includes one or more pieces of nylon netting or other suitable net material capable of preventing mosquitoes from passing through the net material. The netting is wrapped around the outside of the spring coil support 5 and is sewn or otherwise attached at its opposing ends using snaps, Velcro, buttons, hooks or other suitable means such that a seam 8 is formed and runs longitudinally along the support structure 2. In this manner, the net 6 surrounding the spring coil support 5 creates an enclosed space within the expanded mosquito spring net assembly 1. The free edges of the net 6 are formed into sleeves that pass over, or are otherwise attached to, the front and back support rings 3, 4.

Figure 3:
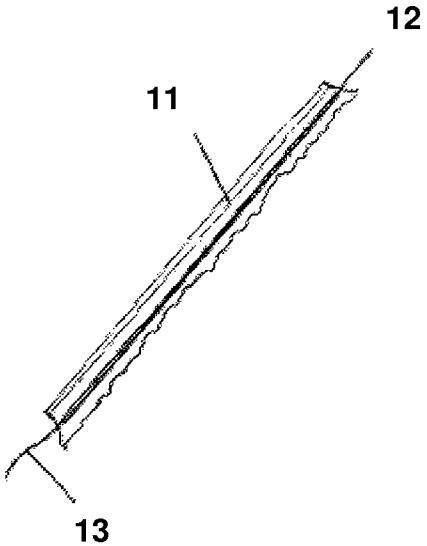
FIG. 3 is a side perspective view of a net cover assembly, according to one embodiment.
Figure 2:
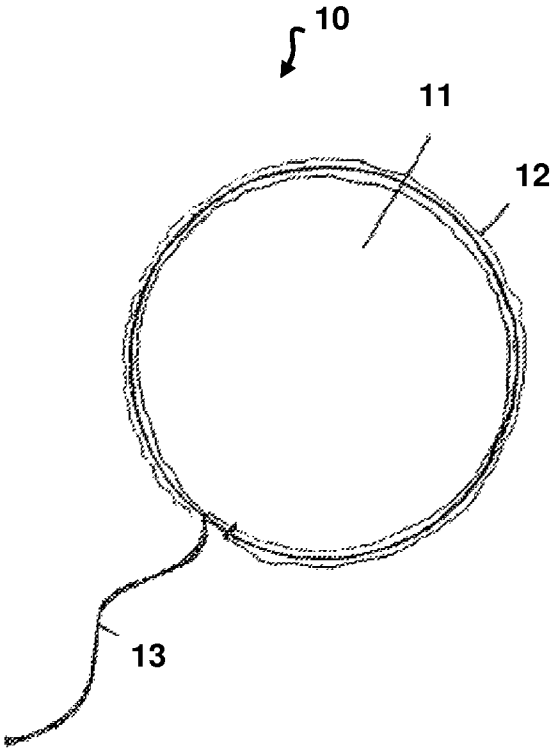
FIG. 2 is a front perspective view of a net cover assembly, according to one embodiment.

In one embodiment, one or both ends of the spring net assembly 1 may be opened to allow a person to enter or exit the spring net assembly 1. The open end or ends may be closed by a net cover assembly 10. As FIGS. 2 and 3 illustrate, the net cover assembly 10 includes a net 11 and an elastic element 12 that forms a closed circle or similar shape that fits over the support rings 3, 4 of the open end or ends in order to complete the enclosure. The elastic element 12 is secured to the support element 2 by an elastic pull 13, which in one embodiment may be a portion of the elastic element 12 that when pulled by a user once inside of the expanded mosquito spring net assembly 1, will provide a cinching action and will result in tightening of the net cover assembly 10 in order to completely enclose the expanded mosquito spring net 1 and prevent mosquitoes and other insects from entering. In another embodiment, one end of the spring net assembly 1 may be permanently closed via a net segment 7 sewn onto the main body of the mosquito net 6.

Figure 4:
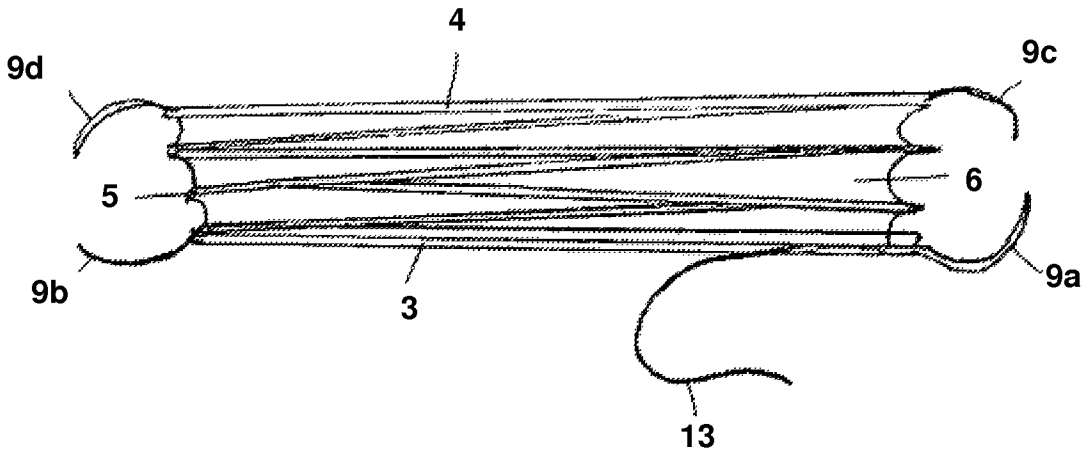
FIG. 4 is a perspective view of a collapsed mosquito spring net assembly, according to one embodiment.

In one embodiment, the mosquito spring net assembly 1 may be collapsible so that it may be stored in a small area. FIG. 4 illustrates the mosquito spring net assembly 1 in a collapsed state resulting from the spring coil support 5 having been compressed to bring the front and back support rings 3, 4 near each other. In order to store the collapsed mosquito spring net assembly 1, the front and back support rings 3, 4 are preferably secured to each other so that the spring coil support 5 is restrained in its compressed position. In one embodiment, the front and back support rings 3, 4 are secured to each other by securing closure element 9*a* to closure element 9*c*, and closure element 9*d* to closure element 9*b*. The closure elements may be fabric ties or other suitable materials that may be secured to one another by tying, snapping, hooking, or by any other suitable means or method.

The mosquito spring net 1 is easily expandable from its collapsed state. The spring coil support 5 acts like a compression spring that stores mechanical energy when loaded. Thus, when the closure elements are released, the energy in the spring coil support 5 is released and the collapsed mosquito spring net 14 springs into its expanded configuration with little or no effort by the user.

Figure 5:
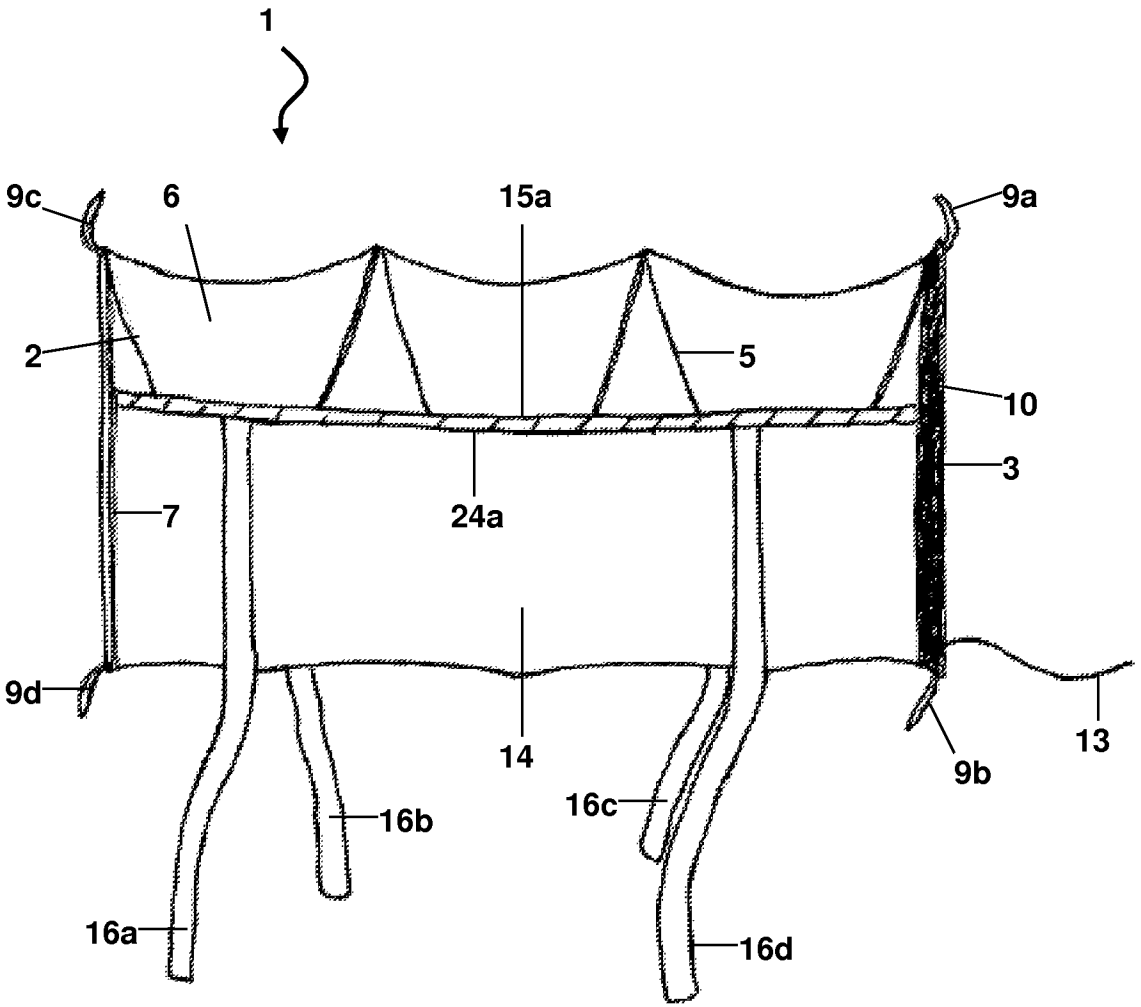
FIG. 5 is a perspective view of an expanded mosquito spring net assembly having an outer lower cover permanently attached to the outside of the net assembly, according to one embodiment.

In some embodiments, a mosquito spring net assembly may include an outer lower cover that covers at least the lower half of the spring net assembly. If a user leans against the mosquito net while inside of the spring net assembly, mosquitoes may still bite the user through the net. Thus, the outer lower cover provides an added layer of protection in addition to the mosquito net to prevent mosquito or other insect bites to the user. Further, the outer lower cover provides additional durability to protect the integrity of the mosquito net material from tearing or other damage when used on the ground or floor. As illustrated in FIG. 5, an outer lower cover 14 may be permanently or releaseably attached to the outside of a mosquito spring net assembly 1. The outer lower cover 14 wraps around the bottom of the mosquito spring net assembly 1 and extends up a portion of each side, and may extend halfway, less than halfway, or more than halfway up each side. The outer lower cover 14 may be made of a flexible, durable material, including, but not limited to, a plastic tarp material. The material should be suitable to provide sufficient durability for the spring net assembly when used on the floor.

To prevent tearing, reinforced seams 15*a*, 15*b* (15*b* not shown) between the mosquito net 6 and the upper sides of the outer lower cover 24*a*, 24*b* (24*b* not shown) may be provided. Attached to the reinforced seams 15*a*, 15*b* (15*b* not shown) are four or more securable straps 16*a*, 16*b*, 16*c*, 16*d* each of which may be tied to a stable object, secured to the ground by stakes, or otherwise suitably secured to provide stability and prevent the mosquito spring net assembly 1 from rolling when in the expanded position.

Figure 6:
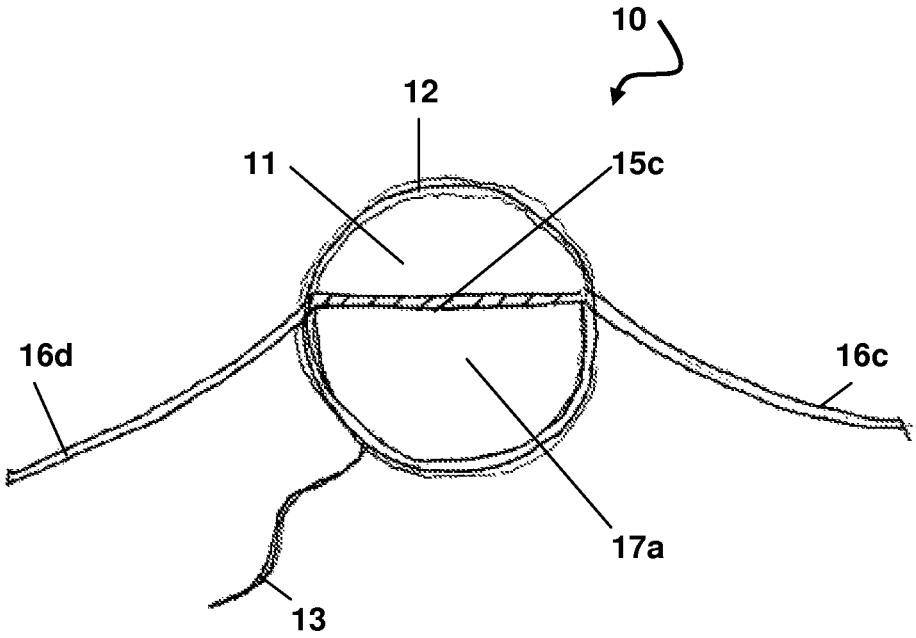
FIG. 6 is a front perspective view of a net cover assembly having an outer lower cover permanently attached to the outside of the net cover assembly, according to one embodiment.

As shown in FIG. 6, a net cover assembly 10 for one end of the mosquito spring net assembly 1 may provide a permanently attached outer lower cover 17*a* with a reinforced seam 15*c*. Similarly, a permanently attached outer lower cover 17*b* with a reinforced seam 15*d* may also be provided on the opposite end of the mosquito spring net assembly 1 (not shown).

Figure 7:
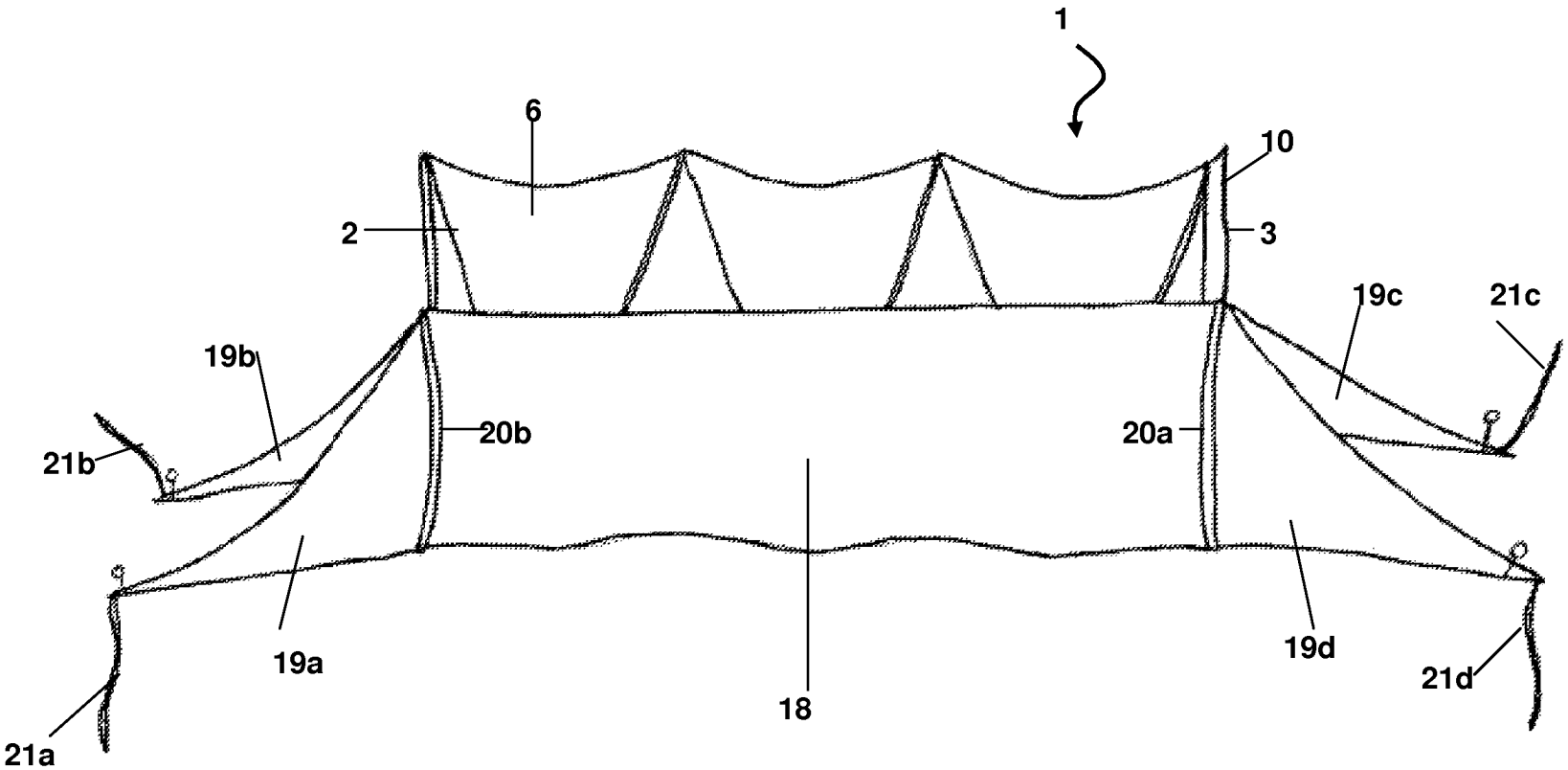
FIG. 7 is a perspective view of an expanded mosquito net assembly placed in an independent outer lower cover crib structure, according to one embodiment.
Figure 8:
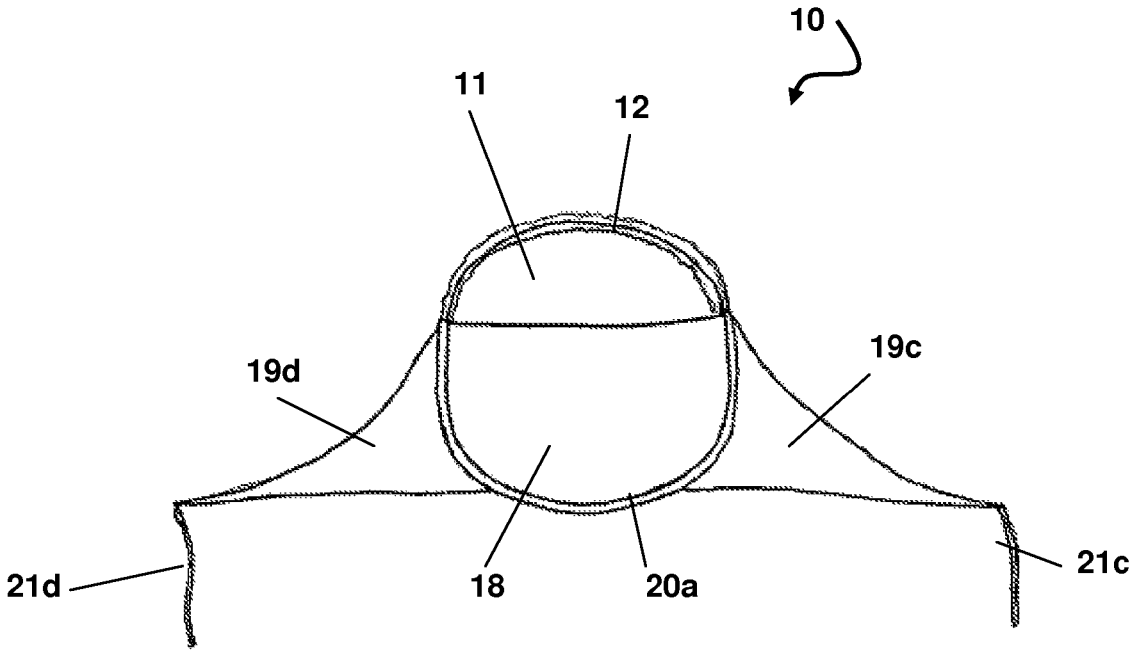
FIG. 8 is a front perspective view of a net cover assembly placed in an independent outer lower cover crib structure, according to one embodiment.
Figure 9:
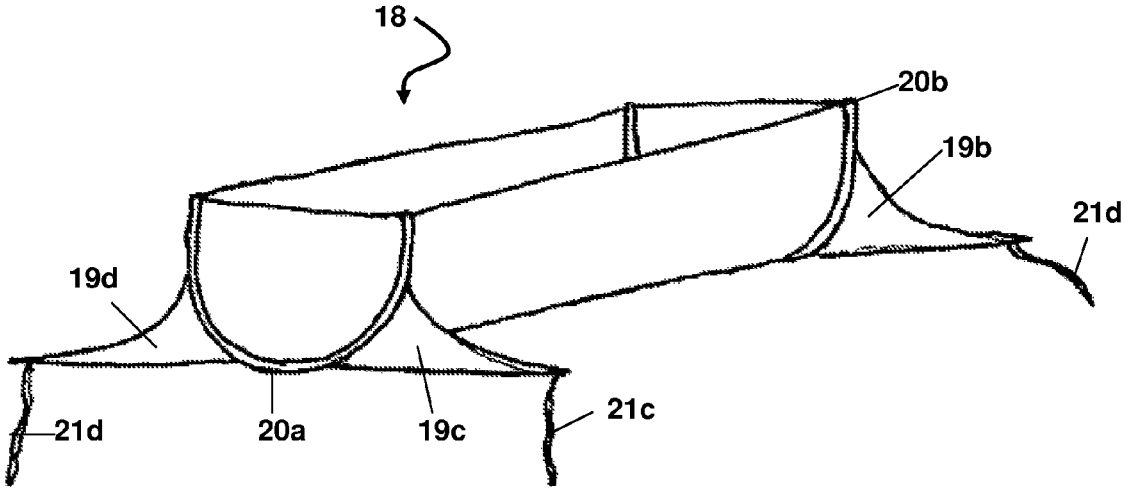
FIG. 9 is a perspective view of an outer lower cover crib structure without an associated mosquito spring net assembly, according to one embodiment.

In an alternative embodiment, the outer lower cover may be a separate "crib" structure that is independent from the mosquito spring net assembly. FIG. 9 illustrates a crib structure 18 without an associated mosquito spring net assembly, while FIGS. 7 and 8 illustrate an outer lower cover crib structure 18 having a mosquito spring net assembly 1 associated with the crib structure 18. The crib structure has at least two horseshoe frame members 20*a*, 20*b*, wherein the horseshoe frame members are made from metal wire, plastic or other suitable material to keep the ends of the crib structure 18 rigid.

Figure 10:
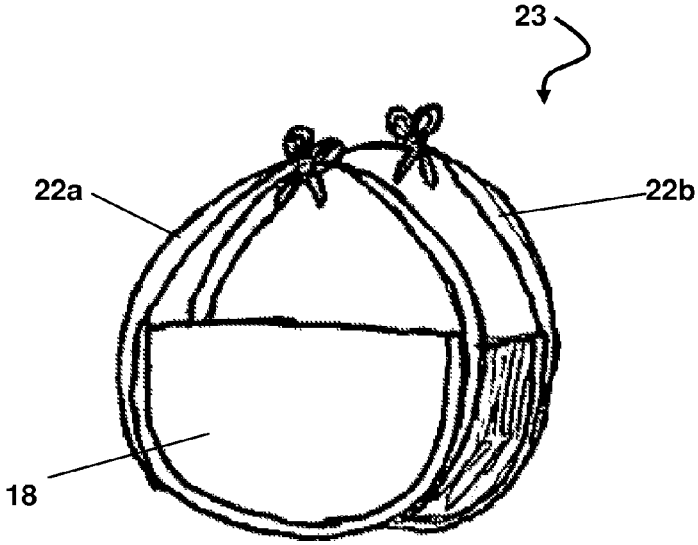
FIG. 10 is a perspective view of an outer lower cover crib structure being used as a container for carrying a mosquito spring net assembly in the collapsed state, according to one embodiment.

Extending from the horseshoe frame members 20*a*, 20*b* are support flaps 19*a*, 19*b*, 19*c*, 19*d* that may be tied down, secured to the ground by stakes, or otherwise suitably secured to provide stability and prevent the mosquito spring net assembly 1 from rolling when in placed in the crib structure 18 in the expanded position. The support flaps 19*a*, 19*b*, 19*c*, 19*d* each have a handle tie element 21*a*, 21*b*, 21*c*, 21*d* that may be used to secure the crib structure as described above or may be tied together to form handles 22*a*, 22*b* as shown in FIG. 10. The support flaps 19*a*, 19*b*, 19*c*, 19*d* may alternatively have snaps, latches, Velcro®, buttons, hooks or other suitable means to connect the support flaps to each other to form handles 22*a*, 22*b*. When the support flaps 19*a*, 19*b*, 19*c*, 19*d* are connected to form handles 22*a*, 22*b*, the crib structure may be used as a container 23 to hold, store or carry a mosquito spring net 1 in the collapsed state.

The inside of the mosquito spring net assembly may be lined with soft felt, fleece or other suitable soft, padded material to add softness and comfort for the user. The lining may be sewn permanently into the interior or the net assembly, or alternatively, may be removably attached to the interior of the mosquito spring net assembly using snaps, latches, Velcro®, buttons, hooks or other suitable means to removably attach the lining to the interior of the net assembly.

Any of the above-described embodiments may be used alone or in combination with one another. Furthermore, a mosquito spring net assembly may include additional features not described herein. While several embodiments have been shown and described, various changes and substitutions may of course be made, without departing from the spirit and scope of the invention. The invention, therefore, should not be limited, except by the following claims and their equivalents.

What is claimed is:

1. A collapsible spring net assembly to protect a user from insect bites, comprising:

a support structure comprising a front support ring, a back support ring and a spring coil support;

a mosquito net covering at least a portion of the support structure;

a plurality of closure elements for securing the front support ring to the back support ring; and a net cover assembly that fits over the front or back support ring comprising (i) a net, (ii) an elastic element, and (iii) an elastic pull that secures the elastic element to the front or back support ring, wherein the elastic element surrounds the front or back support ring and holds the net cover around the ring, thereby preventing mosquitoes and other insects from entering the spring net.

2. The collapsible spring net assembly of claim 1, wherein the support structure has a length of approximately 3 feet.

3. The collapsible spring net assembly of claim 1, wherein the support structure has a diameter of approximately 1.5 feet.

4. The collapsible spring net assembly of claim 1, wherein the support structure comprises 9 gauge aluminum wire.

5. The collapsible spring net assembly of claim 1 wherein one end of the mosquito net is permanently closed.

6. The collapsible spring net assembly of claim 1, wherein the closure elements comprise fabric ties.

7. The collapsible spring net assembly of claim 1, further comprising an outer lower cover.

8. The collapsible spring net assembly of claim 7, wherein the outer lower cover is permanently attached to the collapsible spring net assembly.

9. The collapsible spring net assembly of claim 7, wherein the outer lower cover is an independent crib structure.

10. The collapsible spring net assembly of claim 9, wherein the crib structure can be used as a container to carry the collapsible spring net assembly.

11. A method for protecting a user from exposure to insects, the method comprising:

providing a collapsible spring net assembly in a collapsed state;

releasing closure elements on the spring net assembly such that the spring net assembly springs into an expanded position in which an opening is provided at one end of the spring net assembly;

positioning over the opening, after a user enters the spring net assembly, a net cover assembly including a net, an elastic element, and an elastic pull element that fits over the front or back support ring, wherein the elastic element surrounds the front or back support ring and holds the net cover around the ring; and pulling taut the elastic pull element from inside the spring net assembly to secure the net cover assembly to the spring net assembly to prevent insects from entering.

12. The method of claim 11, further comprising providing an outer lower cover associated with the collapsible spring net assembly.

13. The method of claim 12, wherein the outer lower cover is permanently attached to the mosquito net assembly.

14. A collapsible spring net assembly to protect a user from insect bites, comprising:

a support structure comprising a front support ring, a back support ring and a spring coil support;

a mosquito net covering at least a portion of the support structure;

a plurality of closure elements for securing the front support ring to the back support ring;

a net cover assembly that fits over the front or back support ring comprising (i) a net, (ii) an elastic element, and (iii) an elastic pull that secures the elastic element to the front or back support ring, wherein the elastic element surrounds the front or back support ring and holds the net cover around the ring, thereby preventing mosquitoes and other insects from entering the spring net;

an outer lower cover; and a soft, padded lining attached to the interior of the collapsible spring net assembly.

15. The collapsible spring net assembly of claim 14, wherein the support structure has a length of approximately 3 feet.

16. The collapsible spring net assembly of claim 14, wherein the support structure has a diameter of approximately 1.5 feet.

17. The collapsible spring net assembly of claim 14, wherein one end of the mosquito net is permanently closed.

18. The collapsible spring net assembly of claim 14, wherein the closure elements comprise fabric ties.

19. The collapsible spring net assembly of claim 14, wherein the outer lower cover is permanently attached to the collapsible spring net assembly.

20. The collapsible spring net assembly of claim 14, wherein the outer lower cover is an independent crib structure.

* * * * *